US006700044B1

(12) United States Patent
Bencomo, Jr.

(10) Patent No.: US 6,700,044 B1
(45) Date of Patent: Mar. 2, 2004

(54) ADJUSTMENT ASSEMBLY FOR A MUSICAL DRUM

(76) Inventor: Joseph Bencomo, Jr., 2523 W. Diana St., Tampa, FL (US) 33614

( * ) Notice: Subject to any disclaimer, the term of this patent is extended or adjusted under 35 U.S.C. 154(b) by 0 days.

(21) Appl. No.: 10/260,073

(22) Filed: Sep. 30, 2002

(51) Int. Cl.[7] ..... G10D 13/02
(52) U.S. Cl. ..... 84/411 R; 84/414
(58) Field of Search ..... 84/411 R, 414, 84/418, 419, 420

(56) References Cited

U.S. PATENT DOCUMENTS 4,577,541 A * 3/1986 Edge ..... 84/411 R
4,742,753 A * 5/1988 Speed ..... 84/414
5,583,307 A * 12/1996 Tobia, Jr. ..... 84/411 R
6,057,499 A * 5/2000 Basmadjian ..... 84/411 R

* cited by examiner

*Primary Examiner*—Shih-Yung Hsieh

(57) ABSTRACT

A blocking member provides for selective restriction of a passageway on a membrane of a musical drum to adjust an audio output from the musical drum. The blocking member may be rotationally affixed to the musical drum or may be temporarily positioned thereon. Various configurations are disclosed including blocking members having passageways therethrough and sets of blocking members with each blocking member in the set having a unique characteristic. Adjustment assemblies of the present invention preferably only contact the membrane of the musical drum and not the body of the musical drum. This arrangement provides for the musical drum to retain the vibratory qualities of the membrane while controlling an intensity and duration of that vibration.

20 Claims, 10 Drawing Sheets

ADJUSTMENT ASSEMBLY FOR A MUSICAL DRUM

BACKGROUND

1. Field of the Invention

Generally, the invention relates to devices which adjust an amount of vibration of heads of musical drums. More specifically, the invention relates to such devices which selectively control a release of air from a body of the musical drum during play to control a transmission of sound waves through the air within the musical drum between a striking head of the musical drum and a resonate head of the musical drum thus controlling the sound produced by the musical drum.

2. Description of the Prior Art

Numerous methods exist to tune, or otherwise adjust, an audio output of a musical drum. It is often desirable to perform such adjustment at set up time depending upon variables specific to the location where the performance is to occur. Additionally, it is often desirable to perform such adjustment during short pauses or breaks during the actual performance to correct any perceived imperfections in the audio output from a specific musical drum.

Musical drums which have a resonate head transfer at least some of their audio output via a vibration of the resonate head in response to vibration of the striking head caused by an initial impact of the striking head. The initial vibration of the resonate head occurring because of displacement of air within the interior of the musical drum from the striking head to the resonate head. The continued vibration of the heads occurs, at least in part, because of continued disturbance of the air within the interior of the musical drum between the striking head and the resonate head. It is known in the art to provide for apertures in a head of the musical drum to control a transfer of vibration between the striking head and the resonate head. Such transfer being controlled by allowing some of the air within the body of the musical drum to pass through the apertures and therefore reduce the transfer of vibration between the heads.

A conventional method of adjusting a musical drum involves adjusting a tension of the striking head of the musical drum and/or adjusting a tension of the resonate head of the musical drum. This method satisfactorily provides for adjustment of the audio output in many instances. Unfortunately, this method is time consuming due to the radial arrangement of the tension members about each head of the musical drum and the desire for uniform tension between each of the tension members of the respective head.

Another conventional method of adjusting a musical drum involves adjustment of head contact members which are in physical contact with either of the heads, either the striking or resonate, and with the body of the musical drum. Such contact members are designed to restrict and limit an amount and/or duration of vibration of the applicable head. This is the result of the head being in physical communication with the body of the musical drum at an area of the head within the boundaries of a radially disposed bearing edge formed by the radially disposed edge of the body of the musical drum. Such contact tending to adversely alter the duration of time that the head vibrates as well as the amount of initial vibration. Typically such head contact members either contact a fixed point on the membrane of the head or radially contact the periphery of the membrane of the head. Single contact point assemblies typically have tension adjustment means to allow adjustment of the amount of pressure brought to bear upon the membrane. Radial contact assemblies typically have multiple contact members with one of the contact members selected for deployment in order to make the desired adjustment.

Yet another conventional method of adjusting a musical drum involves placing a damping member within the body of the musical drum between the striking head of the musical drum and the resonate head of the musical drum. Placement of the damping member may involve physical contact with one or both of the heads of the musical drum. Such damping members are designed to effect a transfer of vibration through the air within the musical drum between the striking head and the resonate head and, when in contact with a head, reduce the amount and/or duration of vibration of the head. Unfortunately, this method lacks the fine tuning capabilities desired by musicians and also hinders the musical drum's full sonic potential.

It is known in the art to provide various structures which effect the audio output of the musical drum which are not true adjustment methods, but rather enhance other conventionally known adjustment methods. One example of such structures involve placement of passageways, in the form of a series of pinholes, on one of the heads. Another example of such structures involve heads having two separate membranes typically with a liquid material, such as an oil, positioned therebetween.

As can be seen various attempts have been made to provide for selective variation of the audio output from musical drums. These attempts have been less efficient than desired primarily because they fail to provide for selective variation of an amount of air which may escape from the interior of the musical drum. As such, it may be appreciated that there continues to be a need for a method of adjusting a musical drum which is easy and quick to perform and which yields a rich and varied range of audio outputs. The present invention substantially fulfills these needs.

SUMMARY

In view of the foregoing disadvantages inherent in the known types of musical drum adjustment devices your applicant has devised a method of adjusting a musical drum to obtain a selective variation of a sound of an audio output from the musical drum. The method involves providing a passageway in a membrane while the membrane is positioned on an end of the musical drum, either the striking end or resonate end, while the membrane is either provided with the passageway positioned thereon or is formed in an existing membrane of the musical drum, providing a blocking member and providing means to position the blocking member relative to the passageway of the membrane.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a simple and efficient method of controlling sound produced by a musical drum by controlling the transfer of vibration between the heads of the musical drum.

Other objects include;

a) to provide for adjustment of a musical drum wherein the adjustment may occur extremely fast wherein the musician may make the desired adjustments and immediately continue to play.

b) to provide for adjustment of a musical drum wherein the head does not need to be removed and replaced to make the adjustment.

c) to provide for adjustment of a musical drum-wherein the head does not need to be removed and replaced with another head to make adjustment.

d) to provide for adjustment of a musical drum wherein the adjustment occurs at the resonate head of the musical drum.

e) to provide for adjustment of a musical drum wherein the adjustment occurs at the striking head of the musical drum.

f) to provide for a placement of a passageway on a membrane of the head where the passageway is selectively blocked, in whole or in part, to provide the desired adjustment.

g) to provide for a plurality of passageways on the membrane where the passageways are selectively blocked, in whole or in part, to provide the desired adjustment.

h) to provide for a blocking member having a plurality of passageways thereon where a select passageway of the blocking member is selectively positioned relative to a passageway of the membrane to provide the desired adjustment.

i) to provide for the blocking member utilized for the adjustment to not have an adverse effect upon the vibration characteristics of the associated head.

j) to provide for a plurality of blocking members having unique characteristics to be available for selective positioning relative to the passageway of the membrane.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 2*a* is a front plan view of an existing head as used with the musical drum shown in FIG. 1*a* and FIG. 1*b* and having a membrane and labeled as 'Prior Art'.

FIG. 2*b* is a side plan view of the head shown in .FIG. 2*a* and labeled as 'Prior Art'.

DESCRIPTION

Figure 1A:
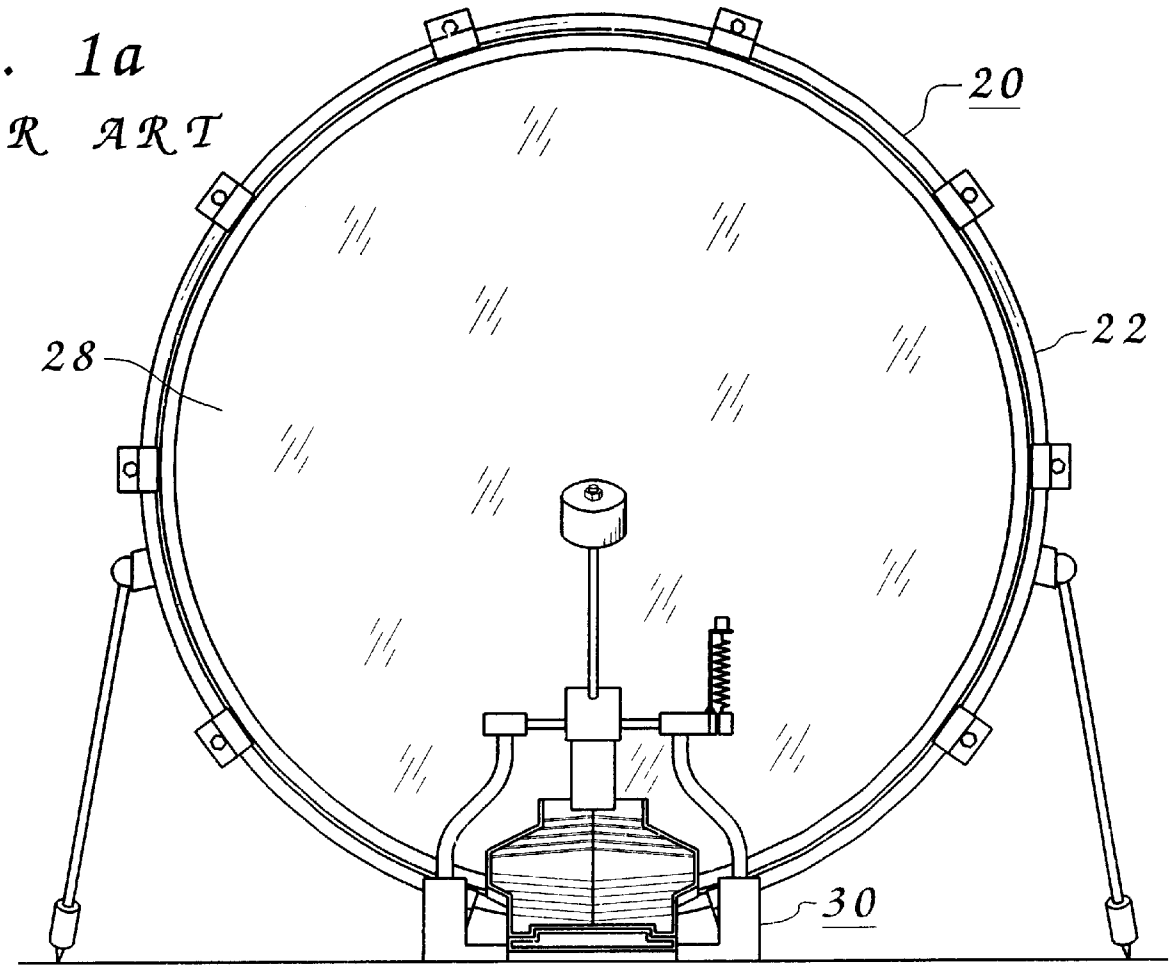
FIG. 1a PRIOR ART
FIG. 1*a* is a rear plan view of a musical drum showing from a striking end of the musical drum and with a foot pedal setup and labeled as 'Prior Art'.

Many different devices having features of the present invention are possible. The following description describes the preferred embodiment of select features of those devices and various combinations thereof. These features may be deployed in various combinations to arrive at various desired working configurations of devices.

Reference is hereafter made to the drawings where like reference numerals refer to like parts throughout the various views.

Adjustment assemblies having features of the present invention will provide for a passageway on a membrane which is on, or will be installed on, a musical drum, some structure to selectively block the passageway and some method of positioning the blocking structure relative to the passageway. The adjustment assembly will provide for a selective variation, depending upon an orientation of the adjustment assembly, in an audio output of the musical drum. This adjustment will also effect the 'feel' of the musical drum during play to control the amount of 'rebound' the musician receives when striking the striking head with a beater or a mallet.

Two general embodiments are possible without departing from the spirit of the present invention. The first involves a removeable blocking member or members which are manually positioned relative to the membrane of the musical drum during the adjustment operation. The second involves a blocking member which is generally attached to the musical drum relative to the membrane wherein the blocking member, or a portion thereof, is moveable, such as rotationally, relative to the passageway of the membrane during the adjustment operation.

Musical Drum

Musical drums applicable to the present invention include those having a striking end and a resonate end with a respective membrane stretched across each end of the musical drum to act as a striking head and a resonate head respectively. The term head as used herein refers to both the surrounding support structure and the membrane secured to the surrounding support structure where the head is positionable on the musical drum at a respective end of the musical drum. The term membrane as used herein refers to the material secured to the surrounding support structure of the head.

Musical drums must vibrate in order to produce an acoustic audio output. Typically such musical drums are provided with a vent hole through the shell or body of the musical drum. Percussion delivered to the striking head stretched across the striking end transfers vibration to the resonate head which vibrates. Depending upon the disturbance of air within the musical drum and the amount of air allowed to escape from the interior of the musical drum the heads continue to vibrate while the air within the musical drum remains in motion. This vibration of the heads produces the audio output from the musical drum. As discussed in the background section various methods are known in the art to adjust an overall audio output from such musical drums. It is known in the art to position a passageway, or a series of passageways, on either of the heads to allow more of the air within the body of the musical drum to be released therethrough which diminishes an amount of vibration of both the striking head and the resonate head and therefore effecting the audio output from the musical drum.

Figure 1B:
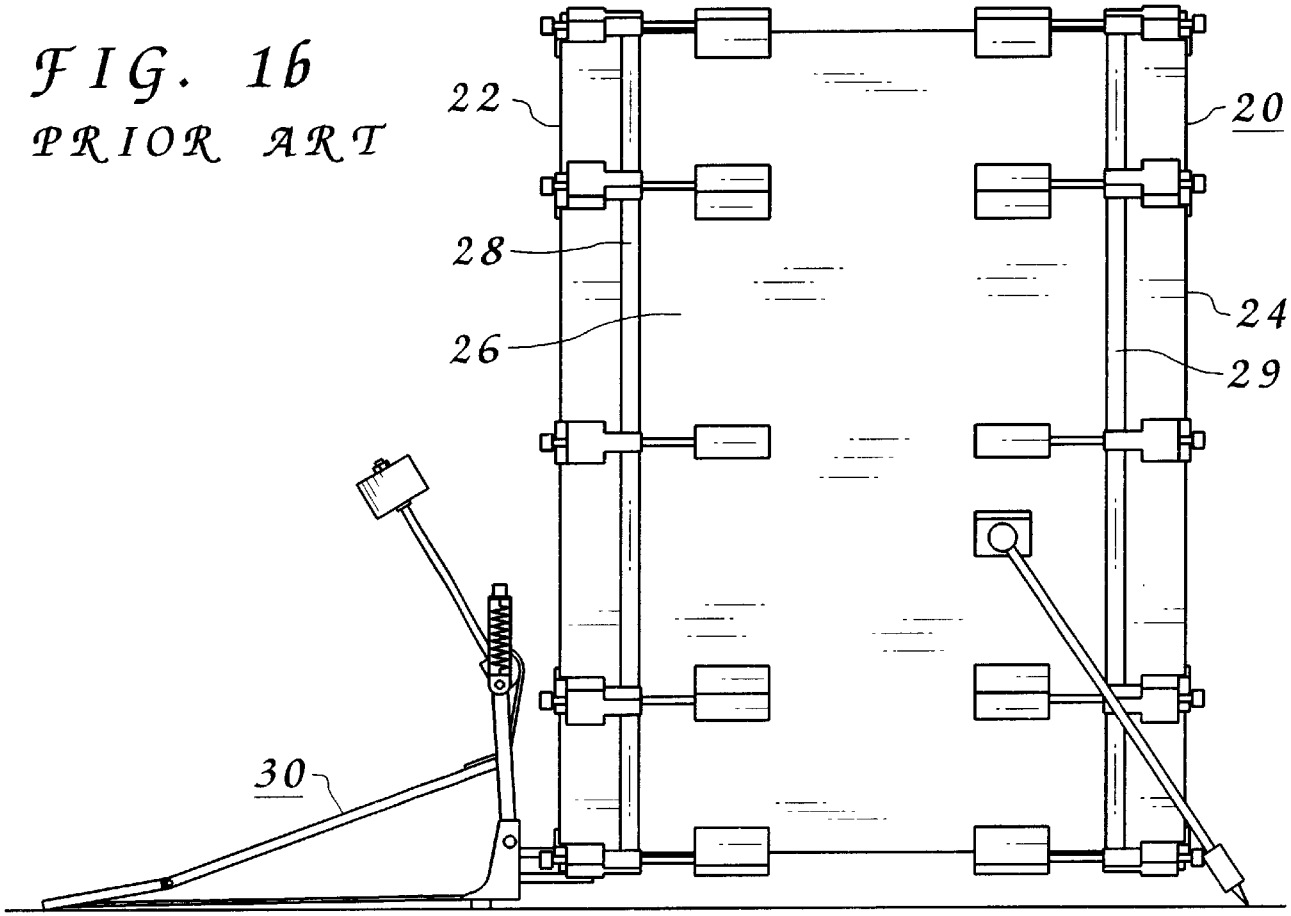
FIG. 1b PRIOR ART
FIG. 1*b* is a side plan view of the musical drum shown in FIG. 1*a* and labeled as 'Prior Art'.
Figures 2A, 2B:
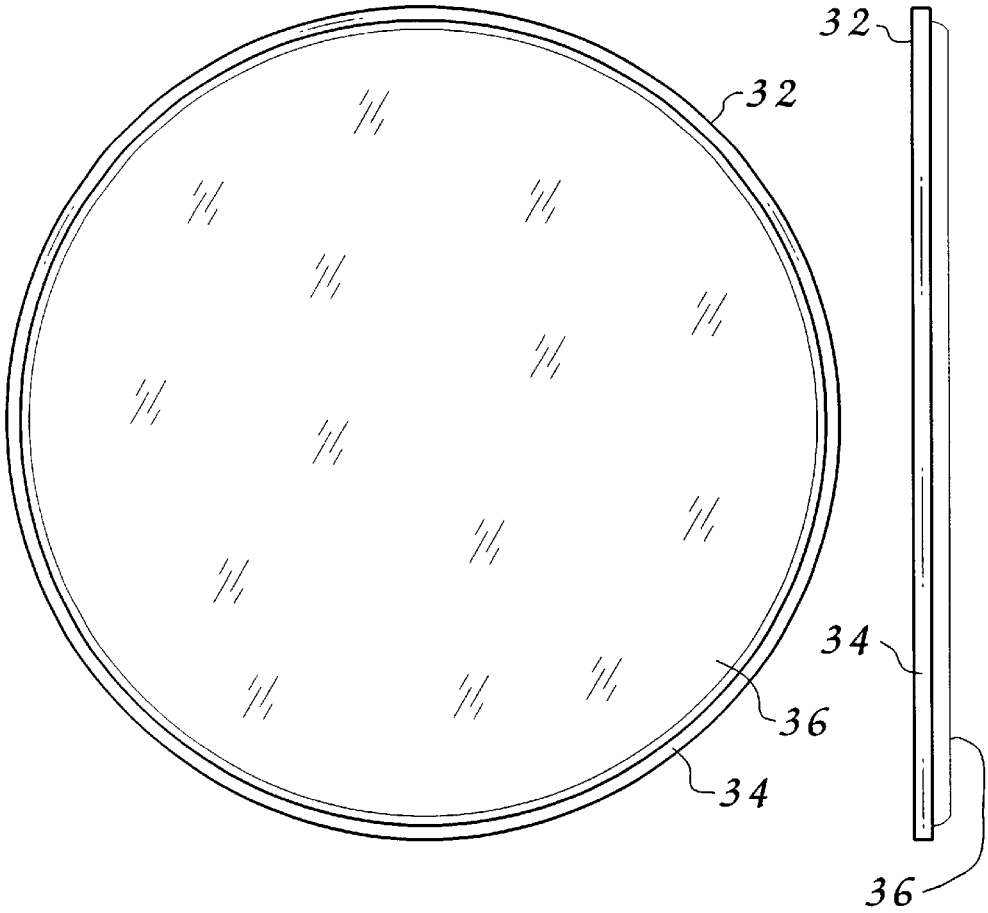
FIG. 2a PRIOR ART
FIG. 2b PRIOR ART

A musical drum 20, see FIG. 1*a* and FIG. 1*b*, has a striking end 22, a resonate end 24, a body 26 and an interior, not shown in the various views, between striking end 22 and resonate end 24. Striking end 22 has stretched thereover a striking head 28 which may be struck, as exampled by impact from a foot pedal assembly 30, to produce an audio output from musical drum 20. Resonate end 24 has stretched thereover a resonate head 29, see FIG. 1*b*, to produce an audio output from musical drum 20 in response to a displacement of air within musical drum 20 in response to movement of striking head 28. An existing head 32 is depicted in FIG. 2*a* and FIG. 2*b* and has a mounting hoop 34 and a membrane 36 anchored to mounting hoop 34. Any conventionally known method of mounting a membrane relative to a musical drum may be utilized for the present invention. The teachings which follow refer to various heads having various membranes. It being understood that such heads generally are applicable to deployment as either the striking head or the resonate head on musical drums applicable to the present invention.

Membrane

Membranes are respectively tensioned relative to each end of the musical drum to form, with the respective support structure, the striking head and the resonate head. Each head initially vibrates as a result of impact against the striking head of the musical drum. Membranes applicable to the present invention will have at least one passageway thereon which acts to release a portion of the air pressure from within the interior of the musical drum. The release of air pressure from the interior of the musical drum reduces transfer of vibration between the heads. The passageway may extend to the edge of the respective head of the musical drum or, more preferred, will form an opening through the membrane without extending to the edge. The passageway may be positioned at any desired location on the membrane. When a single passageway is employed for the resonate head an offset position is preferred although a central position may also be utilized. A periphery position is preferred for the striking head in order to preserve a suitable play area thereon. The passageway may have any desired shape with round being the preferred shape. While a single passageway through the membrane is preferred, multiple passageways may be provided. When multiple passageways are used each may have an identical size or each may have a unique size.

The membrane utilized for the present invention may be an existing installed head of the musical drum which is modified to install the desired passageway or passageways thereon or it may be supplied with the passageway or passageways thereon for subsequent installation on the musical drum. The term passageway means as used herein is applicable, in either instance, to provide for positioning a passageway on a membrane.

FIG. 2*a* and FIG. 2*b* depict membrane 36 which is part of head 32 which may be positioned on musical drum 20, shown in FIG. 1*a* and FIG. 1*b*. Various other heads each having a membrane are depicted in the various views with each capable of being installed on musical drum 20.

Figure 3:
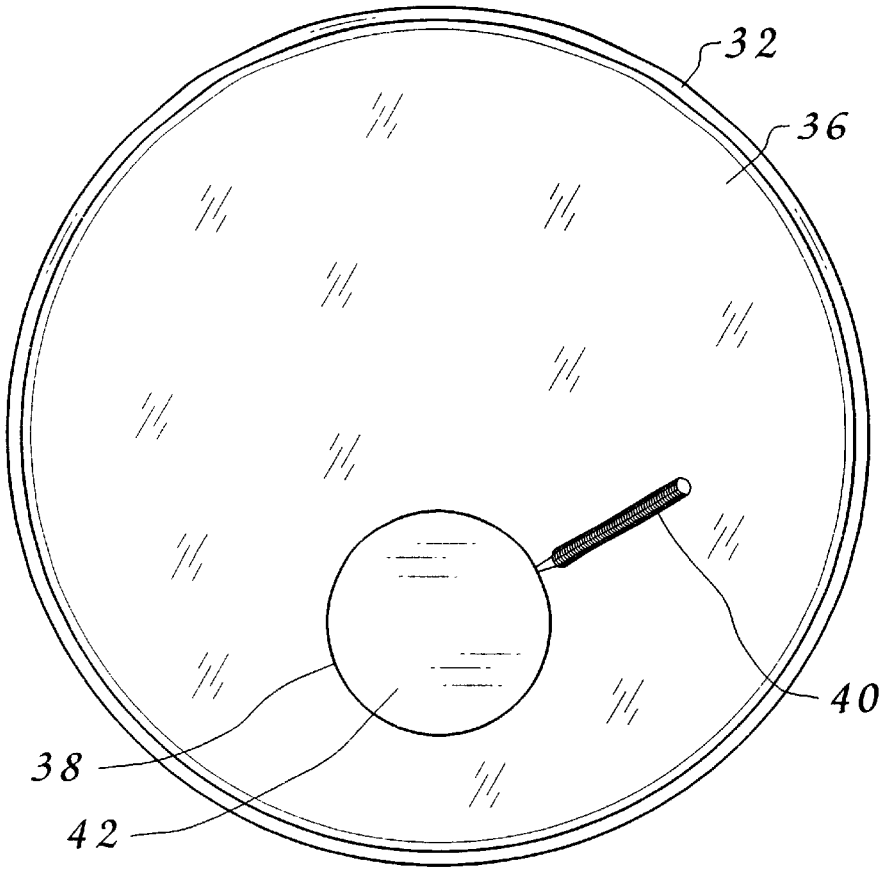
FIG. 3 is a front plan view of the head shown in FIG. 2*a* and FIG. 2*b* during installation of an aperture therethrough the membrane.

FIG. 3 depicts head 32 during an installation of a passageway 38, outline shown, through membrane 36 by a cutting process utilizing a knife 40. While a free hand cutting may be employed preferably a guide, such as a template 42, will be provided to ensure that a desired size and shape are obtained for the resulting passageway 38. Preferably, template 42 has an adhesive, not shown, which affixes template 42 to membrane 36 during the cutting operation. FIG. 5*b* depicts head 32 following the above described operation and having passageway 38 formed through membrane 36.

Figure 6A:
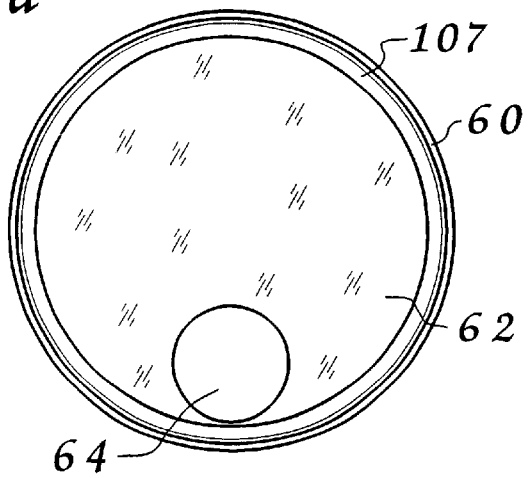
FIG. 6*a* is a front plan view of a head.
Figure 6B:
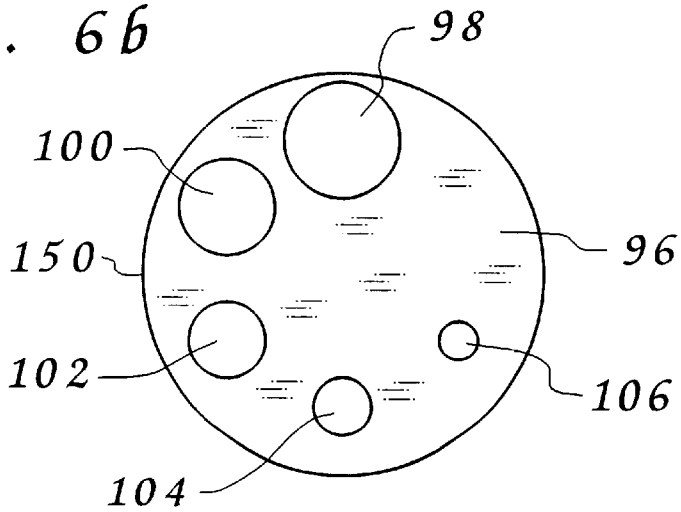
FIG. 6*b* is a front plan view of a blocking member.
Figure 6C:
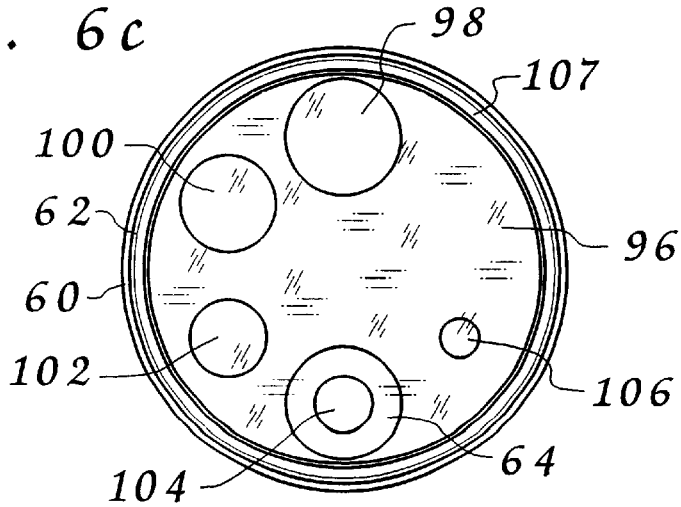
FIG. 6*c* is a front plan view of the blocking member shown in FIG. 6*b* installed on the head shown in FIG. 6*a*.

FIG. 6*a* and FIG. 6*c* depict a head 60 having a membrane 62 having a passageway 64 therethrough.

Figure 7A:
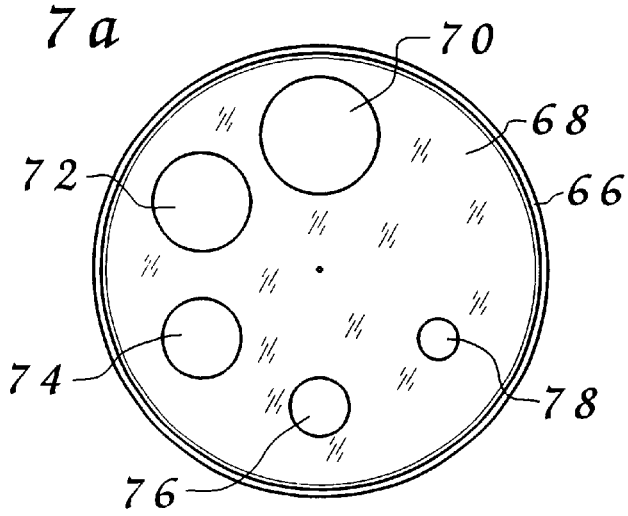
FIG. 7*a* is a front plan view of a head.
Figure 7B:
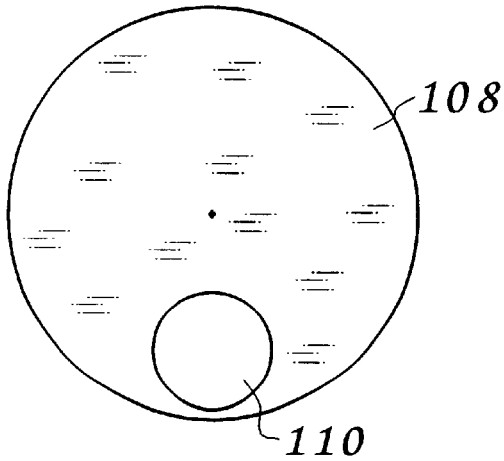
FIG. 7*b* is a front plan view of a blocking member.
Figure 7C:
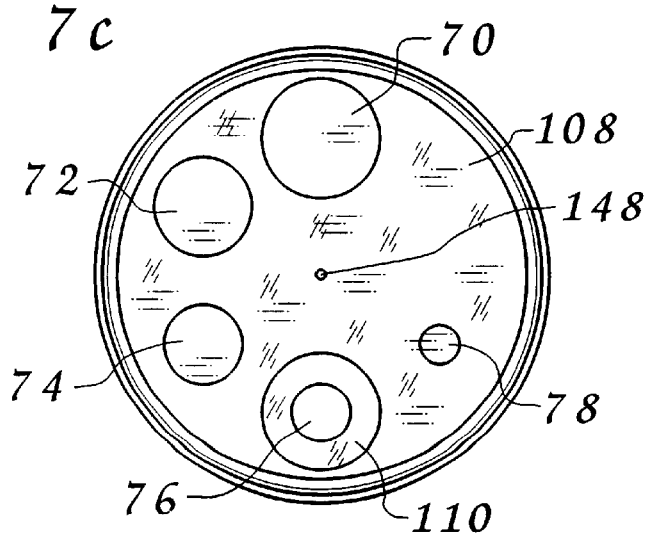
FIG. 7*c* is a front plan view of the blocking member shown in FIG. 7*b* installed on the head shown in FIG. 7*a*.

FIG. 7*a* and FIG. 7*c* depict a head 66 having a membrane 68 having passageways 70, 72, 74, 76 and 78 therethrough.

Figure 8A:
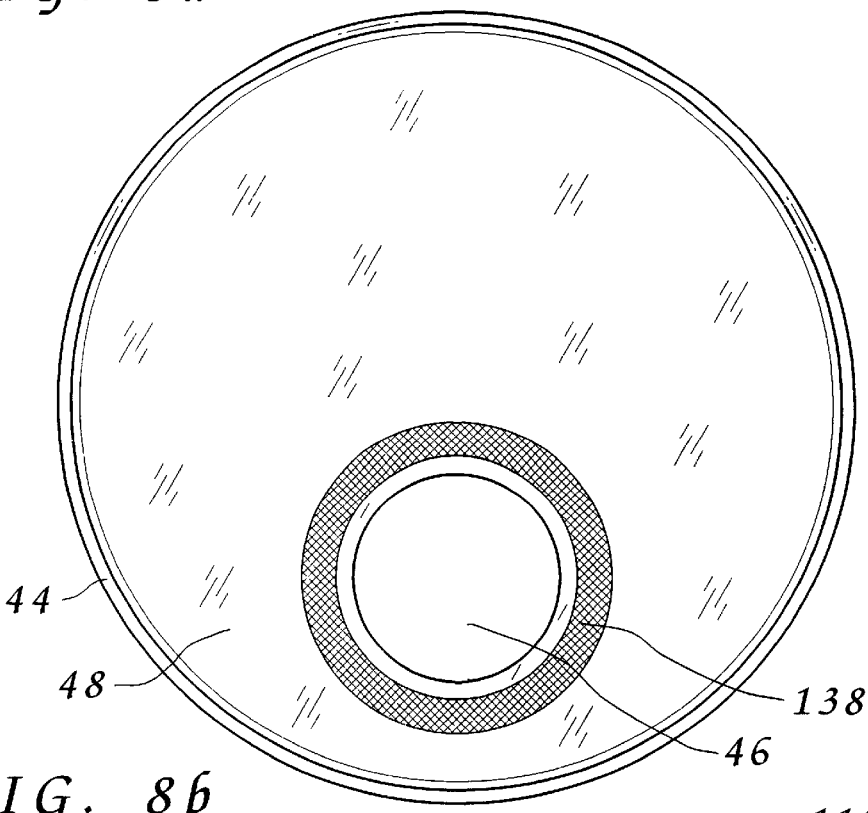
FIG. 8*a* is a front plan view of a head.

FIG. 8*a* depicts a head 44 having a passageway 46 formed through a membrane 48 during a manufacturing process. FIG. 4*b* depicts a head 50 having a membrane 52 having a plurality of passageways 54 therethrough. Each passageway 54 has the same size.

Figure 9A:
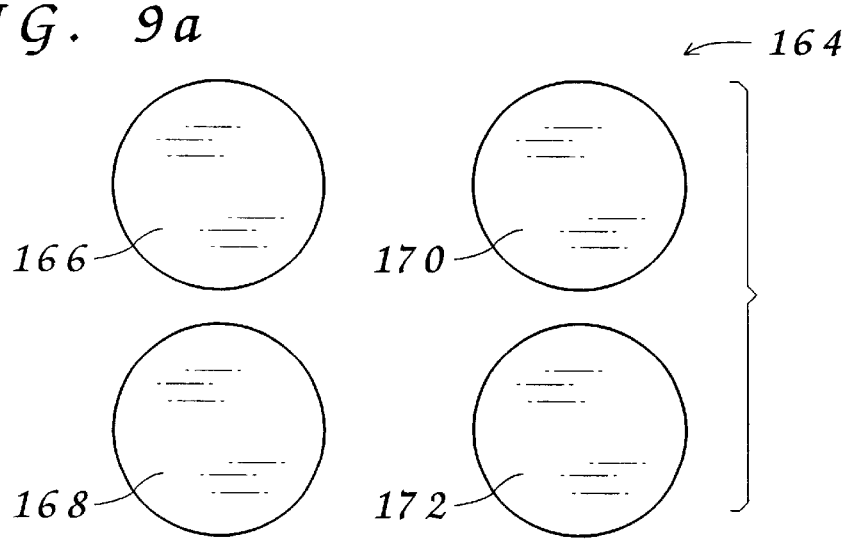
FIG. 9*a* is a front plan view of a head.
Figure 9B:
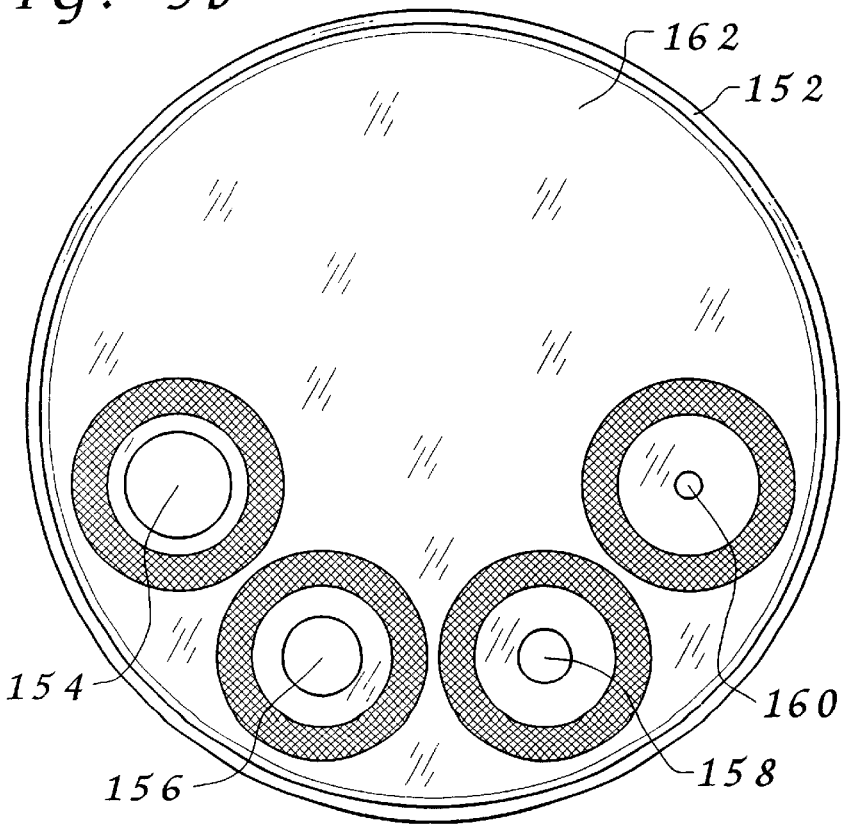
FIG. 9*b* is a plan view of a set of blocking members.

FIG. 9*b* depicts a head 152 having passageways 154, 156, 158 and 160 formed through a membrane 162. Each passageway 154, 156, 158 and 160 has a unique size.

Blocking Member

A blocking member will act to selectively close, or partially close, a passageway positioned on the membrane. The term blocking means as used herein refers to selectively blocking at least a portion of a passageway on a membrane. Numerous structural configurations for the blocking member may be employed without departing from the spirit of the present invention. A single blocking member may be provided or multiple blocking members may be provided. When multiple blocking members are provided a single blocking member may be selected from the group for sole use or multiple blocking members may be used simultaneously, depending upon the configuration of the adjustment assembly deployed. The blocking member may have a passageway therethrough or may have multiple passageways therethrough. When the blocking member has multiple passageways it is preferred to have each passageway have a unique size. Because the membrane is planar between the radial contact with the body of the musical drum preferably the blocking member will have a substantial planar area of sufficient size to perform the desired blocking action relative to the passageway of the membrane.

Without regard for whether a single passageway is deployed on the membrane or whether multiple passageways are deployed on the membrane the blocking member may be so arranged to partially close off the passageway on the membrane. This may be provided for by providing means to position the blocking member is various locations relative to the passageway on the membrane. Alternatively, a single general placement location may be provided for a blocking member relative to the passageway on the membrane while providing a plurality of blocking members to choose from with each blocking member having a unique characteristic, such as a uniquely sized passageway therethrough.

Figure 4A:
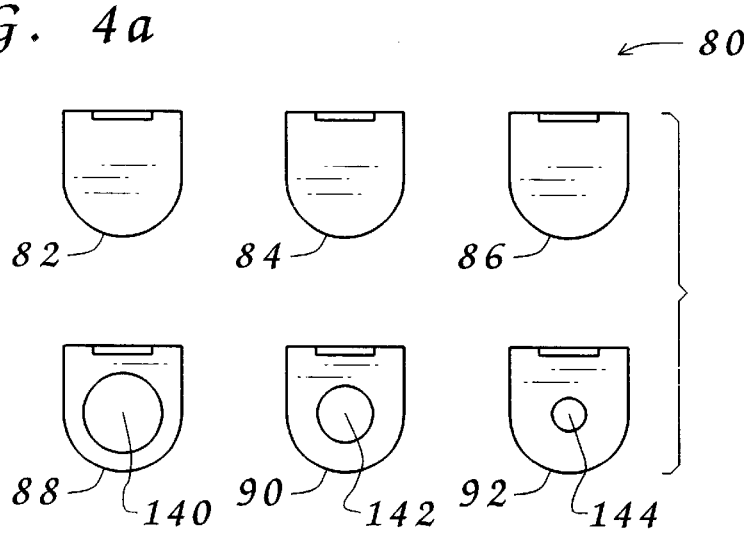
FIG. 4*a* is a plan view of a set of blocking members.
Figure 4B:
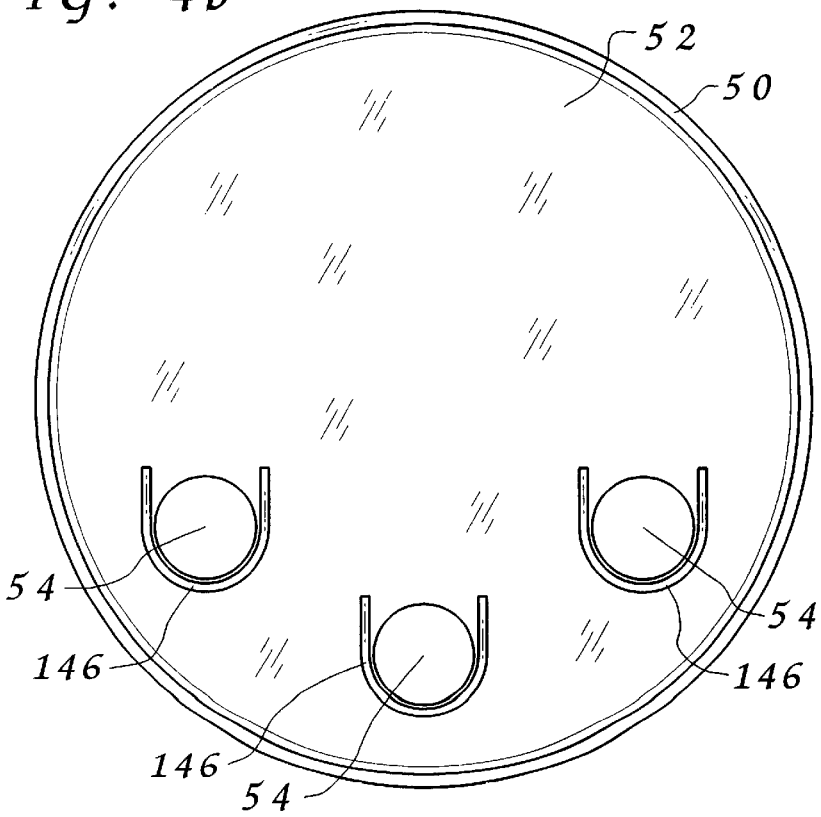
FIG. 4*b* is a front plan view of a membrane.
Figure 8B:
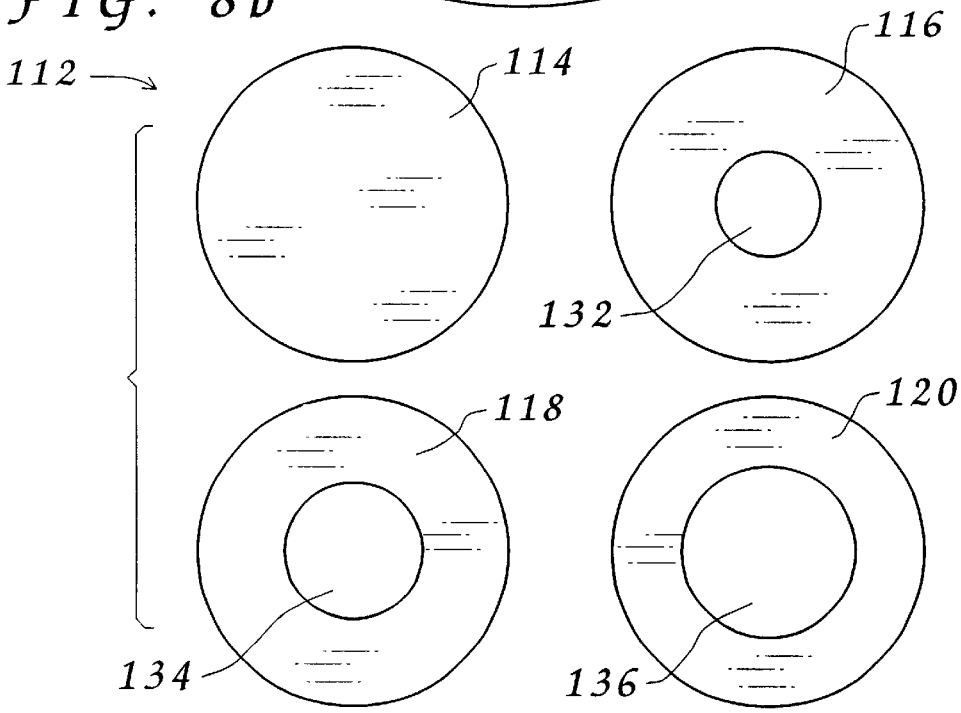
FIG. 8*b* is a plan view of a set of blocking members.

FIG. 4*a* depicts a set 80 of blocking members 82, 84, 86, 88, 90 and 92 capable of being deployed in various configurations relative to passageways 54 of head 50, see FIG. 4*b*. FIG. 5*b* and FIG. 5*b* depict a blocking member 94 capable of multiple positioning relative to passageway 38 of head 32, see FIG. 5*b*. FIG. 6*b* and FIG. 6*c* depict a blocking member 96 having passageways 98, 100, 102, 104 and 106 therethrough and capable of being deployed in various positional arrangements relative to passageway 64 on membrane 62 of head 60, see FIG. 6*a* and FIG. 6*c*. FIG. 7*b* and FIG. 7*c* depict a blocking member 108 having a passageway 110 therethrough and capable of being deployed in various positional arrangements relative to passageways 70, 72, 74, 76 and 78 on head 66, see FIG. 7*a* and FIG. 7*c*. FIG. 8*b* depicts a set 112 of blocking members 114, 116, 118 and 120 capable of being deployed in various configurations relative to passageway 46 of head 44, see FIG. 8*a*. FIG. 9*b* depicts a set 164 of blocking members 166, 168, 170 and 172 capable of being deployed in various configurations relative to passageways 154, 156, 158 and 160 of head 152, see FIG. 9*a*. Each blocking member 166, 168, 170 and 172 is solid without a passageway therethrough.

Positioning Means

The term positioning means as used herein refers to positioning the blocking member relative to the passageway of the membrane. This positioning may have a single placement orientation or may have various placement orientations. Many different methods are known in the art to temporarily position one object in close proximity, if not outright contact, with another object and many of these methods may be employed for the present invention.

A simple contact bonding may be employed such as that which occurs when a first part of a hook and loop type fastener is affixed to the membrane about the passageway and a second part of the hook and loop type fastener is affixed to, or even forms, the blocking member. Such simple contact bonding may be attached in numerous positional orientations while being attached and detached repeatedly.

A simple sliding contact coupling may be employed. Such sliding contact may employ a sleeve and panel arrangement. In this instance the sleeve may be affixed to the membrane about the passageway and the panel, which acts as the blocking member, may be inserted into the sleeve to close, or partially close, the passageway. In this type of deployment it is preferred to provide several blocking members having unique characteristics. When dual ply heads are employed a slit, or other access area, may be formed in one of the membranes for positioning therethrough of the blocking member which acts upon a passageway formed through both membranes.

A simple rotational deployment may be employed such as that which occurs when the blocking member has a shape which, at least in part, generally matches the membrane within the contact area with the radially disposed edge of the body of the musical drum. In this instance an edge of the blocking member may be used to selectively block as much of a passageway of the membrane as desired. Alternately, a plurality of passageways may be deployed on the membrane and/or a plurality of passageways may be deployed on the blocking member where a selection of the amount of the open area may be made. In any embodiment using the simple rotational deployment method adjustment would be made by rotating the blocking member relative to the membrane until the desired exposure was obtained. When a rotational deployment is utilized a radial contact member or members may be used to retain and/or guide the blocking member relative to the membrane. Preferably some form of retention will be employed with any moveable blocking member and particularly when a rotational displacement is utilized to prevent movement from the selected deployment orientation. A variation of the rotational deployment method involves providing a plurality of plate type members with an outer peripheral radial securement and coupling means to provide for a selective radial adjustment of an exposed aperture. This variation provides for adjustment of the resultant aperture as is conventionally known in the art for 'F stop' adjustment in camera lenses.

A simple pivotal arrangement may be utilized wherein the blocking member, in the form of a flap, is pivotally attached relative to the passageway of the membrane of the head of the musical drum. Such pivotal displacement may simply have an open orientation and a closed orientation or may have selectable positions therebetween which allow for incremental variation of adjustment.

The blocking member can be in direct contact with the membrane or it can be spaced therefrom slightly or portions may be in direct contact with other portions spaced slightly therefrom. When spaced from the membrane preferably a spacing member will be sandwiched therebetween to provide for a desired contact where the membrane will retain a desired capacity to vibrate and provide the rich sounds desired. When a spacing member is positioned between the membrane and the blocking member it is preferred to form the spacing member from a slightly compressible material such as a foam material and have the spacing member only positioned around the periphery edge of the membrane.

Figure 5A:
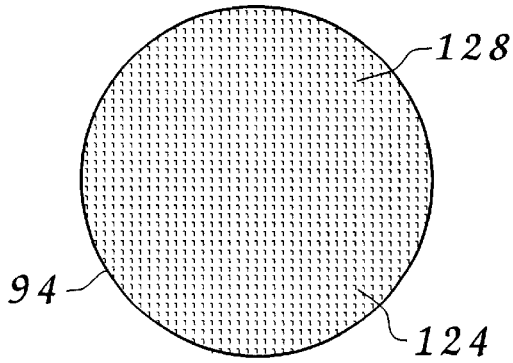
FIG. 5*a* is a plan view of a back of a blocking member.
Figure 5B:
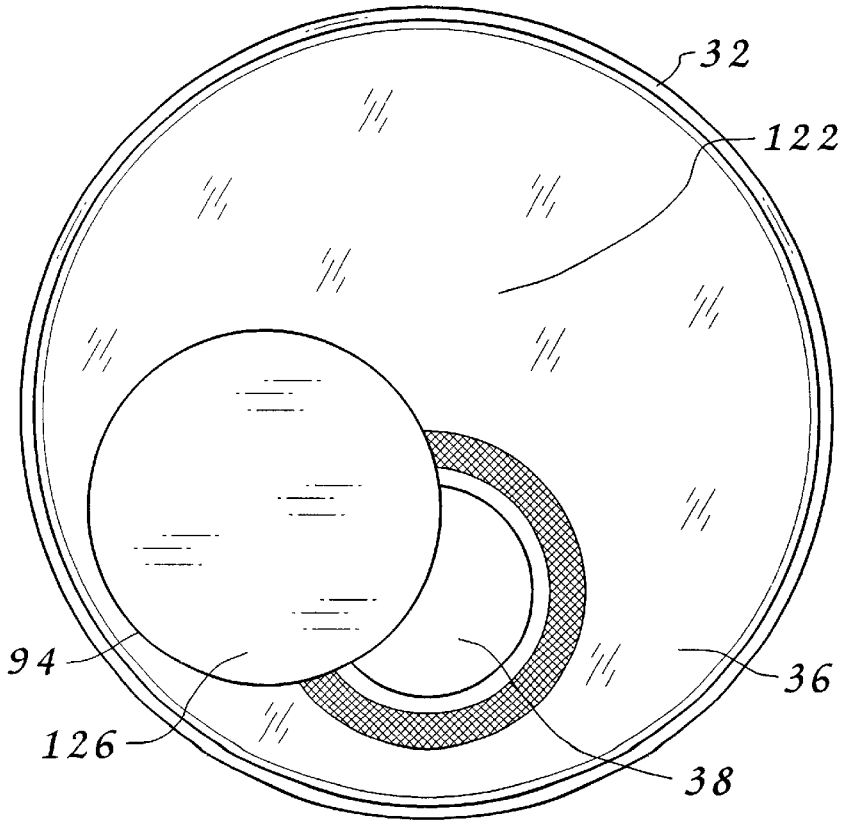
FIG. 5*b* is a front plan view of a head with the blocking member shown in FIG. 5*a* positioned thereon.

FIG. 5*a* depicts positioning of blocking member 94 relative to passageway 38 through membrane 36 of head 32 utilizing opposing members, a first part 122 and a second part 124, see FIG. 5*a*, of a hook and loop type fastener. In this embodiment blocking member 94 has sufficient rigidity to not bend or fold away from head 32 during use. A front 126 of blocking member 94 is shown in FIG. 5*b* while a back 128 of blocking member 94 is shown in FIG. 5*a*. First part 122, depicted as the hook part but capable of being either, is affixed to back 128 of blocking member 94, see FIG. 5*a*, utilizing an adhesive, not shown. Second part 124, depicted as the loop part but capable of being either, is affixed to membrane 36 of head 32 utilizing an adhesive, not shown, about passageway 38. FIG. 5*b* depicts blocking member 94 partially covering passageway 38. A very large variety of placement positions exist where the musical drum, not shown in these views, having head 32 installed thereon may be fine tuned to provide a wide range of sound qualities for the audio output of the musical drum.

FIG. 8*a* depicts a variation of the above described positioning method wherein set 112 of blocking members 114, 116, 118 and 120 are provided formed of one part of the hook and loop type fastener or having one part of the hook and loop type fastener attached thereto, backs not shown. In this example blocking member 114 is solid without a passageway therethrough while blocking member 116 has a small sized passageway 132 therethrough while blocking member 118 has a medium sized passageway 134 therethrough while blocking member 120 has a large sized passageway 136 therethrough. FIG. 8*a* depicts the opposing part of the hook and loop type fastener affixed to membrane 48 of head 44 about passageway 46 as a coupling band 138. In use one blocking member 114, 116, 118 or 120 would be selected and temporarily attached to coupling band 138 to close, or partially close, passageway 46. This arrangement provides a satisfactory number of variations to provide for the desired adjustment of the audio output of a musical drum on which head 44 is installed, not shown in these views.

FIG. 4*a* depicts blocking members 88, 90 and 92 of set 80 having a passageway 140, 142 and 144 respectively each having a unique size. FIG. 4*b* depicts membrane 52 of head 50 having passageways 54 each having an identical pocket 146 positioned thereabout. FIG. 4*a* depicts set 80 of blocking members 82, 84, 86, 88, 90 and 92. Any select blocking member 82, 84, 86, 88, 90 or 92 may be positioned within any pocket 146 about any select passageway 54. This wide variety of deployment selections provide for adjustment within a wide range of sound qualities for the audio output for a musical drum, not shown in these views, on which head 50 is installed.

Referring now to FIG. 6*a*, FIG. 6*b* and FIG. 6*c*, membrane 62 of head 60 has passageway 64 therethrough while blocking member 96 has passageways 98, 100, 102, 104, and 106 therethrough. In use head 60 would be installed on a musical drum, not shown in these views, in a fixed, or non rotational, manner. Blocking member 96 would be positioned against, or in close proximity to, membrane 62 of head 60. Preferably blocking member 96 will be positioned outside of membrane 62 for ease of manipulation, as shown in FIG. 6*c*, but it is possible to position blocking member 96 on the inside of membrane 62 when installed on a musical drum. By rotating blocking member 96 many variations of blocking, or partial blocking, of passageway 64 of membrane 62 of head 60 may occur. Rotation and positioning of blocking member 96 relative to head 60 provides for the desired adjustment. As an enhancement to contact and guidance between blocking member 96 and head 60 a radial pressure band 107, see FIG. 6*a* and FIG. 6*c*, can be positioned relative to head 60 to apply pressure to blocking member 96 in close proximity to an edge 150, see FIG. 6*b*, of blocking member 96. Such pressure may utilize a compressible foam ring if desired to apply the desired pressure.

Referring now to FIG. 7*a*, FIG. 7*b* and FIG. 7*c*, membrane 68 of head 66 has passageways 70, 72, 74, 76 and 78 therethrough while blocking member 108 has passageway 110 therethrough. In use head 66 would be installed on a musical drum, not shown in these views, in a fixed, or non rotational, manner. Blocking member 108 would be positioned against, or in close proximity to, membrane 68 of head 66. Rotation and positioning of blocking member 108 relative to head 66 provides for the desired adjustment. As an enhancement to ready rotation, a pivot pin 148, see FIG. 7*c*, may be employed to penetrate both membrane 68 of head 66 and blocking member 108 to maintain a centering of blocking member 108 relative to head 66.

FIG. 9*a* and FIG. 9*b* depict an embodiment of deployment wherein each passageway 154, 156, 158 and 160 has a unique size. Blocking members 166, 168, 170 and 172 are positionable relative to passageways 154, 156, 158 and 160 to selectively close any select combination of passageways 154, 156, 158 and 160 or selectively leave any select combination of passageways 154, 156, 158 and 160 open.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustment assembly for a musical drum, the musical drum having a striking end and a resonate end, the adjustment assembly to provide for a selective variation of an audio output from the musical drum, the adjustment assembly comprising:

a) passageway means to provide for positioning a passageway on a membrane, the membrane positioned at an end of the musical drum;

b) a blocking member;

c) positioning means to provide for positioning the blocking member relative to the passageway of the membrane.

2. The adjustment assembly defined in claim 1 wherein the membrane is positionable relative to the resonate end of the musical drum.

3. The adjustment assembly defined in claim 1 wherein the membrane is positionable relative to the striking end of the musical drum.

4. The adjustment assembly defined in claim 1 wherein the positioning means further comprises providing the membrane in close proximity to the passageway with first attachment means, the first attachment means comprising a plurality of attachment members of a hook and loop type fastener, and wherein the positioning means further comprises providing the blocking member with second attachment means to function with the first attachment means, the second attachment means comprising a plurality of opposing attachment members of the hook and loop type fastener.

5. The adjustment assembly defined in claim 1 wherein the positioning means further comprises providing the membrane in close proximity to the passageway with first sliding attachment means, and wherein the positioning means further comprises providing the blocking member with second sliding attachment means wherein the positioning means functions as a result of a sliding coupling of the blocking member relative to the membrane.

6. The adjustment assembly defined in claim 1 wherein the passageway means further comprises cutting the passageway into an existing membrane of the musical drum.

7. The adjustment assembly defined in claim 1 wherein the passageway means further comprises providing the membrane for positioning on the musical drum with the passageway positioned on the membrane.

8. The adjustment assembly defined in claim 1 further comprising at least one additional blocking member having a unique size relative to a size of the blocking member.

9. The adjustment assembly defined in claim 1 wherein the passageway means further comprises positioning at least one additional passageway on the membrane and wherein the additional passageway has a unique size to a size of the passageway.

10. An adjustment assembly for a musical drum, the musical drum having a striking end and a resonate end, the adjustment assembly to provide for a selective variation of an audio output from the musical drum, the adjustment assembly comprising:

a) a membrane positioned over an end of the musical drum, the membrane having a passageway thereon;

b) a plurality of blocking members, each blocking member for positioning in close proximity to the membrane;

c) positioning means to provide for selectively positioning at least one of the blocking member relative to the passageway of the membrane.

11. The adjustment assembly defined in claim 10 wherein at least one of the blocking members further comprises a planar area of sufficient area and shape to completely cover the passageway of the membrane.

12. The adjustment assembly defined in claim 10 wherein each of the blocking members further has a passageway therethrough.

13. The adjustment assembly defined in claim 10 wherein each of the blocking members has a unique size.

14. An adjustment assembly for a musical drum, the musical drum having a striking end and a resonate end, the adjustment assembly to provide for a selective variation of an audio output from the musical drum, the adjustment assembly comprising:

a) a membrane positioned over an end of the musical drum, the membrane having a plurality of passageways thereon;

b) blocking means to provide for selectively blocking at least a portion of at least one of the passageways of the membrane.

15. The adjustment assembly defined in claim 14 wherein the passageways of the membrane further comprise at least two distinct sizes.

16. The adjustment assembly defined in claim 14 wherein the blocking means further comprises a blocking member having a passageway therethrough.

17. The adjustment assembly defined in claim 14 wherein the blocking means further comprises a plurality of blocking members.

18. The adjustment assembly defined in claim 17 wherein each of the blocking members has a passageway therethrough.

19. The adjustment assembly defined in claim 14 wherein the blocking means further comprises positioning means and wherein the positioning means further comprises a rotation of a blocking member relative to the membrane.

20. An adjustment assembly for a musical drum, the musical drum having a striking end and a resonate end, the adjustment assembly to provide for a selective variation of an audio output from the musical drum, the adjustment assembly comprising:

a) a membrane positioned over an end of the musical drum, the membrane having a passageway thereon;

b) a blocking member having a plurality of passageways therethrough;

c) positioning means to provide for selectively positioning the blocking member wherein a desired quantity of the passageway of the membrane is exposed.

* * * * *